US006761267B1

(12) United States Patent
DeFoor

(10) Patent No.: US 6,761,267 B1
(45) Date of Patent: Jul. 13, 2004

(54) PASTEL CARRIER

(76) Inventor: Bruce DeFoor, 3705 Tom Watson, Clovis, NM (US) 88101

( * ) Notice: Subject to any disclaimer, the term of this patent is extended or adjusted under 35 U.S.C. 154(b) by 84 days.

(21) Appl. No.: 10/050,092

(22) Filed: Jan. 17, 2002

(51) Int. Cl.[7] ..... A45C 11/34
(52) U.S. Cl. ..... 206/214; 206/446
(58) Field of Search ..... 206/214, 443, 206/446, 372, 373, 379, 371, 224, 479, 523; 383/39, 40

(56) References Cited

U.S. PATENT DOCUMENTS

| | | | | | |
|---|---|---|---|---|---|
| 291,415 | A | | 1/1884 | Spencer | |
| 424,603 | A | | 4/1890 | Favor | |
| 440,507 | A | | 11/1890 | Sanders | |
| 754,558 | A | | 3/1904 | Greves | |
| 2,228,493 | A | | 1/1941 | Will | |
| 3,134,416 | A | | 5/1964 | Magyer | |
| 3,256,527 | A | | 6/1966 | Studen | |
| 3,389,195 | A | | 6/1968 | Gianakos et al. | |
| 3,460,740 | A | | 8/1969 | Hagen | |
| 3,631,973 | A | | 1/1972 | Rode | |
| 3,732,663 | A | * | 5/1973 | Geldmacher | 53/412 |
| 3,838,806 | A | * | 10/1974 | Dogliotti | 220/23.8 |
| 4,901,464 | A | * | 2/1990 | Banoun | 42/95 |
| 4,970,821 | A | * | 11/1990 | Young | 43/54.1 |
| D323,065 | S | * | 1/1992 | Stricklin et al. | D3/206 |
| 5,320,223 | A | * | 6/1994 | Allen | 206/372 |
| 5,388,689 | A | | 2/1995 | Kroop et al. | |
| D356,334 | S | * | 3/1995 | Kroop et al. | D19/36 |
| 5,524,765 | A | * | 6/1996 | Gutentag | 206/713 |
| D424,807 | S | * | 5/2000 | Dembicks | D3/313 |
| 6,070,729 | A | * | 6/2000 | Barnes | 206/581 |
| 6,253,922 | B1 | * | 7/2001 | Hadden | 206/733 |
| D452,077 | S | * | 12/2001 | Dembicks | D3/313 |
| 6,484,881 | B1 | * | 11/2002 | Alvite | 206/714 |

* cited by examiner

*Primary Examiner*—Shian T. Luong
*Assistant Examiner*—E. Payton
(74) *Attorney, Agent, or Firm*—Fay, Sharpe, Fagan, Minnich & McKee

(57) ABSTRACT

A carrier for elongate, cylindrical chalk sticks comprises a body of flexible material having opposite ends, opposite sides, and inner and outer surfaces. Chalk stick pockets extend into the body from the inner surface toward the outer surface in four rows spaced apart in the direction between the opposite sides and each row includes 50 pockets spaced apart in the direction between the opposite ends. The pockets are elongated in the direction between the opposite sides of the body, and said body is rollable in the direction between the opposite ends to form a roll enclosing said pockets and which roll can be releasably held in the rolled condition by suitable fasteners.

14 Claims, 2 Drawing Sheets

PASTEL CARRIER

BACKGROUND OF THE INVENTION

This invention relates to the art of artist's supplies and, more particularly, to a carrier for colored chalk sticks known as pastels.

It is of course well known that pastels are crayons or chalk sticks made of ground colors and pastel paste, and that pastels vary greatly in color and very delicate and fragile. The term pastel is also used to designate an art media of drawings created through the use of pastel chalk sticks.

Pastels are, most often, cylindrical and, generally, about ½" in diameter and 3" in length prior to use. However, there are pastels available in other sizes such as, for example, ¾" in diameter and 1½" in length, and ¼" to 5/16" in diameter and 4" to 4½" in length. Also, pastels are sometimes square or oval in cross-section. The fragile nature thereof makes it difficult for an artist to carry and/or store his or her pastels without breakage. Moreover, an artist may have as many as 200 to 400 pastels which he or she has to store and/or use in a studio environment, or transport from a home or studio to another site or location, either indoors or outdoors, at which he or she intends to use the pastels in creating a pastel drawing. Heretofore, both storage and transportation of more than a few pastels has evolved the use of large, rigid containers of wood, plastic, or the like having pocketed interiors for the pastels and a closure which can be opened to gain access to the interior. Such containers can, for example, be 18"×22" and 6" deep and contain drawers for the pastels. Another examples a box measuring 20"×24"×1½" and containing 180 pastel sticks. Accordingly, regardless of the material from which the container is made, the latter is relatively heavy, considerable storage space is required for the container, and transportation of the container is cumbersome. Moreover, if the artist is working outdoors, the containers are subject to damage from dirt, rocks or other on which the container may be laid. Furthermore, if transportation involves the use of a vehicle, adequate space for the container becomes an issue with many vehicles. The latter is especially true when it is realized that the artist will more than likely be transporting other equipment such as an easel, drawing paper, and a support for holding the paper in place on the easel.

SUMMARY OF THE INVENTION

In accordance with the present invention, a pastel carrier is provided which overcomes the foregoing and other difficulties encountered in connection with the storage and transportation of pastels. More particularly in this respect, a carrier in accordance with the present invention includes a body of flexible material having individual pockets for receiving individual pastel chalk sticks and which is rollable, in the manner of a bedroll, so as to enclose the pastels within the carrier body. Preferably, the flexible body includes a strip of polymeric material, such as foamed polyurethane, and the pockets are sized such that rolling of the body constricts the pockets into engagement with pastels that are in the pockets so as to secure the pastels in the pockets during storage and/or transportation. Moreover, the individual pockets in the body of flexible material advantageously cushion the chalk sticks therein, thus optimizing support thereof against breakage and maintaining the sticks against contact with one another to further optimize protection against breakage. Advantageously, a carrier in accordance with the present invention can, for example, accommodate 200 pastels ½" in diameter and 3" in length in four rows of 50 pockets each in the carrier body and which carrier, when rolled, has a length of 15 inches, a diameter of about 6 inches, and a weight, when full, of about 3–4 pounds. Accordingly, it will be appreciated that both storage and transportation of pastels with a carrier according to the present invention are enhanced relative to carriers heretofore available for an equivalent number of pastels. Preferably, the rolled body is releasably maintained in the rolled condition such as through the use of strings, ribbons, elastic bands, Velcro fasteners, or the like which may be separate from or structurally associated with the flexible body. It is also preferred that the outer surface of the rolled carrier body be defined by a fabric material, such as canvas, nylon or the like to protect the strip of polymeric material from damage during both use and storage of the carrier. Advantageously, when the carrier roll is unrolled to a flat condition, the pockets in the carrier body support the individual pastel chalk sticks against contact with one another and, furthermore, optimize accessability to the individual chalk sticks as the artist uses the latter in making a pastel drawing.

It is accordingly an outstanding object of the present invention to provide an improved carrier for pastel chalk sticks.

Another object is the provision of a carrier for pastel sticks having individual pockets for the sticks and which carrier is rollable to form a roll in which the chalk sticks are enclosed.

A further object is the provision of a pastel carrier of the foregoing character in which the individual chalk sticks are cushioned and thus supported against breakage.

Still another object is the provision of a pastel carrier of the foregoing character which is easier to transport and store than carriers heretofore available for storing and transporting a corresponding number of pastel chalk sticks.

Still another object is the provision of a pastel carrier of the foregoing character which is light in weight, capable of being rolled into a compact package, thus to optimize ease of transporting and storing the carrier.

Yet a further object is the provision of a pastel carrier of the foregoing character which is inexpensive to manufacture and efficient with respect to the storage of pastels therein and the accessability of the pastels for use.

Another object is the provision of a pastel carrier of the foregoing character which, both during storage and use, optimizes support and protection of the individual chalk sticks while, in use, also optimizing the user's accessability to the individual chalk sticks.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
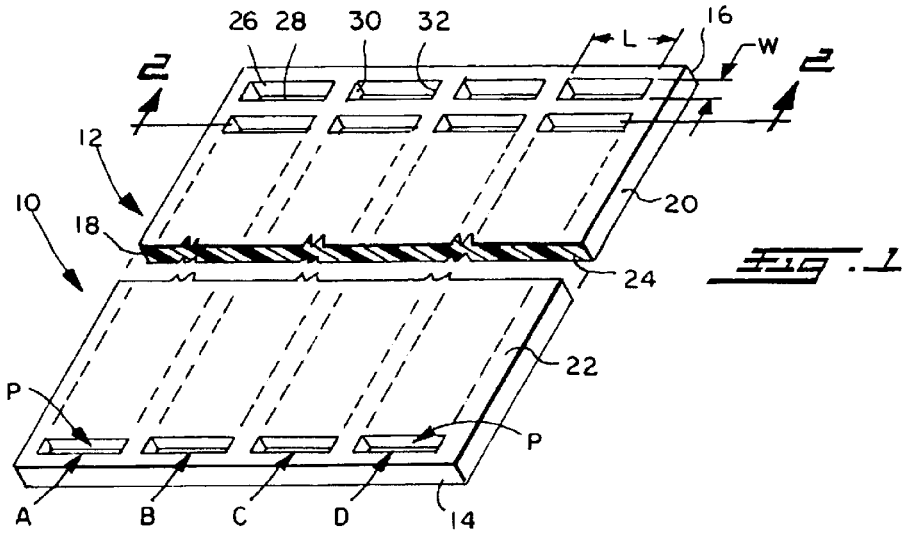
FIG. 1 is a perspective view of a pastel carrier in accordance with the invention.
Figure 2:
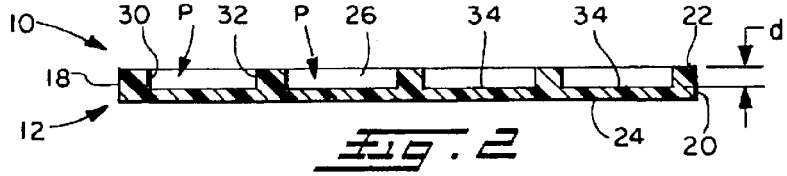
FIG. 2 is a cross-sectional elevation view of the carrier taken along line 2—2 in FIG. 1.
Figure 3:
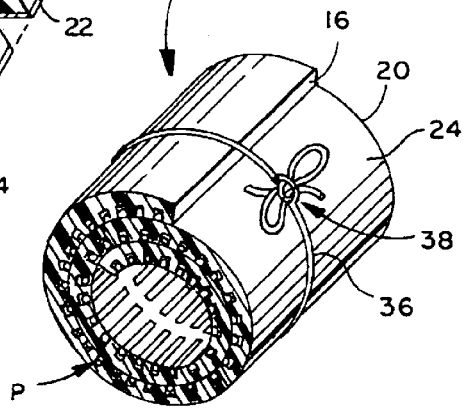
FIG. 3 is a perspective view, partially in section, of a portion of the carrier in the rolled condition thereof.

Referring now in greater detail to the drawings, wherein the showings are for the purpose of illustrating preferred embodiments of the invention only and not for the purpose of limiting the invention, FIGS. 1–3 illustrate a pastel carrier 10 comprising a body of flexible material which, in this embodiment, is a strip 12 of resilient material having opposite ends 14 and 16, opposite sides 18 and 20, a top side 22 providing an inner surface for the carrier and a bottom side 24 providing an outer surface for the carrier. Preferably, strip 12 is constructed from a polymeric material such as foamed polyurethan. The carrier body is provided with a plurality of pockets P which, in the embodiments illustrated in the drawings, are in four rows A, B, C, and D spaced apart between sides 18 and 20. Each of the rows includes a plurality of pockets P spaced apart in the direction between ends 14 and 16 of the body. Each pocket P extends from inner surface 22 toward outer surface 24 and has a length L in the direction between sides 18 and 20, a width W in the direction between ends 14 and 16, and a depth d in the direction between surfaces 22 and 24. More particularly in this respect, each pocket P has spaced apart parallel side walls 26 and 28 providing width W, spaced apart parallel end walls 30 and 32 providing length L and a planar bottom wall 34 parallel to surface 22 and providing depth d therewith. Preferably, width W and depth d correspond generally to the diameter of a chalk stick to be received therein, and length L corresponds generally to the initial length of the chalk stick. In the embodiment illustrated in FIGS. 1–3, strip 12 has a width of 15 inches between sides 18 and 20, a length of 42 inches between ends 14 and 16, and a thickness of ¾ inch between surfaces 22 and 24. Pockets P have a length L of three inches, a width W of ½ inch, and depth d of ½ inch. Further, each of the rows A, B, C, and D comprise 50 pockets P, and the pockets are arranged in alignment with one another both laterally and longitudinally of strip 12.

In use, carrier 10 is in the flat condition shown in FIG. 1, whereby the pastel chalk sticks in pockets P are readily accessible to the user. To facilitate transporting and storing the pastel carrier, body strip 12 is rolled in the direction from one of the ends 14 and 16 toward the other to the rolled condition shown in FIG. 3 wherein the body has been rolled in the direction from end 14 to end 16. Preferably, the carrier is positively releasably maintained in the rolled condition to facilitate transportation and storage thereof, although it will be appreciated that the rolled carrier could be carried so as to preclude unrolling thereof. Likewise, the carrier could be supported against unrolling such as by positioning the roll between retaining surfaces which could be provided, for example, by the bench and back of a seat in a vehicle, or the like. However, it is preferred as mentioned above to positively hold the rolled carrier in the rolled condition and, as shown in FIG. 3, this can be attained by tying one or more of a ribbon, string or cord 36 about the rolled carrier with a knot 38, whereby the rolled carrier is releasably held in the rolled condition. Still further, it will be appreciated that such a positive holding of the carrier in the rolled condition can be achieved through the use of a variety of fastening arrangements, some of which are disclosed hereinafter, or by placing the rolled carrier in a box or bag dimensioned to support the rolled carrier against unrolling. It will be appreciated, too, that the carrier could be releasably held in the rolled condition by an elastic band or bands extending thereabout.

Figure 4:
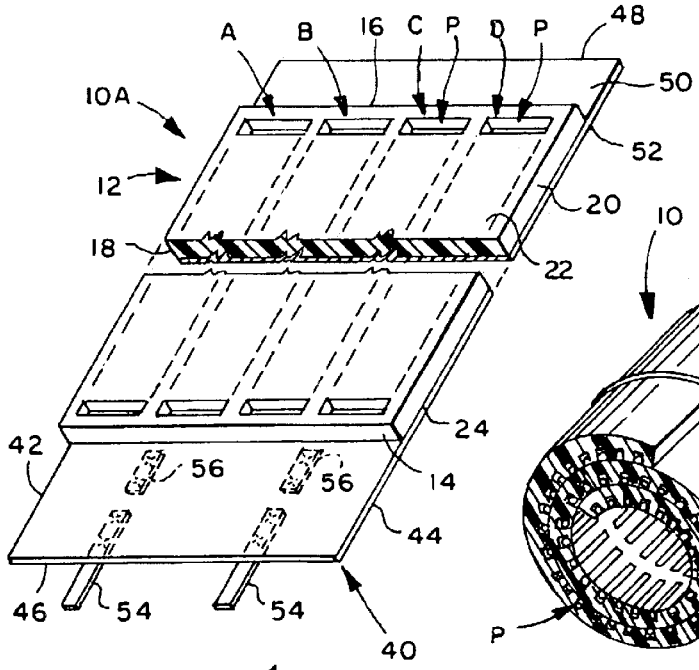
FIG. 4 is a perspective view of another embodiment of a pastel carrier in accordance with the present invention.

FIG. 4 illustrates a modification of the pastel carrier shown in FIGS. 1–3 and wherein the carrier, designated 10A, comprises a body of flexible material defined by strip 12 as described hereinabove and a sheet 40 of a fabric or cloth such as, for example, cotton canvas, linen, a polyester fabric such as nylon, or the like. Sheet 40 is adhesively bonded or otherwise suitably secured to bottom side 24 of strip 12 such as by Velcro or double-faced adhesive tape, for example. Sheet 40 has opposite sides 42 and 44 which coincide with sides 18 and 20 of strip 12, respectively, and opposite ends 46 and 48 which extend longitudinally outwardly from ends 14 and 16 of strip 12, respectively. Further, sheet 40 has a top side 50 which is secured to bottom side 24 of strip 12, and a bottom side 52 which defines the outer race of the body of flexible material in this embodiment. In this embodiment, one end of sheet 40 is provided with two sets of cooperative Velcro fastener elements 54 and 56 which are stitched or otherwise secured to the bottom side of sheet 40 for the fastener elements 54 to extend longitudinally beyond end 46 and for the fastener elements 56 to extend longitudinally inwardly of the sheet toward end 48 thereof. As will be appreciated from the description of the embodiment illustrated in FIGS. 1–3, pastel carrier 10A is adapted to be rolled in the direction from end 16 of strip 12 toward end 14 thereof whereby, when rolled to the configuration shown in FIG. 3, Velcro fastener elements 54 are adapted to engage with the corresponding fastener element 56 to releasably hold the pastel carrier in the rolled condition.

Figure 5:
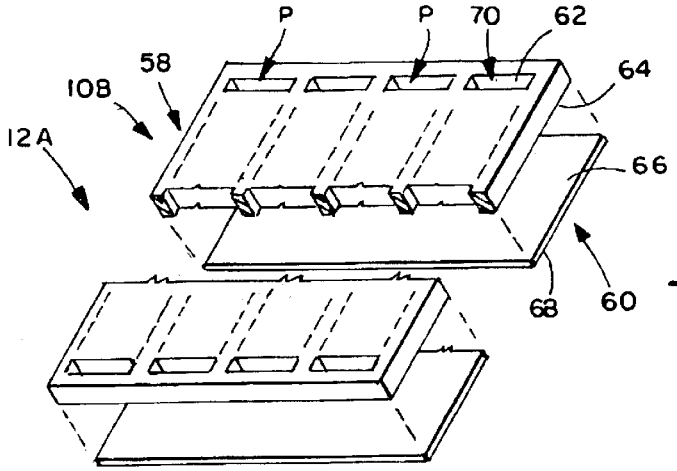
FIG. 5 is a perspective view of yet another embodiment of a pastel carrier in accordance with the invention.

As described hereinabove in connection with the embodiments illustrated in FIGS. 1–4, strip 12 is ¾ inch thick and pockets P are cut thereinto to a depth of ½ inch. FIG. 5 illustrates a pastel carrier 10B comprising a strip 12A which is a structural modification of the strip 12 and which is preferred with respect to minimizing the cost of manufacture thereof. In this respect, the strip 12A comprises a strip 58 and a sheet 60, each of the same material as described hereinabove with regard to strip 12. Sheet 60 is suitably secured to the bottom side of strip 58 such as by adhesive bonding or the use of double-faced adhesive tape. Strip 58 is ½ inch thick and sheet 60 is ¼ inch thick, whereby the overall thickness dimension corresponds to that of strip 12 as described hereinabove. Strip 58 has top and bottom sides 62 and 64, respectively, and sheet 60 has top and bottom sides 66 and 68, respectively. In this embodiment, pockets P are provided by die cutting openings 70 through strip 58 from side 62 to side 64 thereof prior to bonding sheet 60 thereto. When top side 66 of sheet 60 is bonded to bottom side 64 of strip 58, top side 66 of sheet 60 covers the openings through strip 58 and provides the bottom walls for pockets P. Further, top side 62 of strip 58 and bottom side 68 of sheet 60 in the body of flexible material thus defined respectively provide the inner and outer surfaces of the body of flexible material. Accordingly, it will be appreciated that the pastel carrier can be rolled as described in connection with FIG. 3 and releasably held in the rolled position to facilitate transportation and storage thereof.

Figure 6:
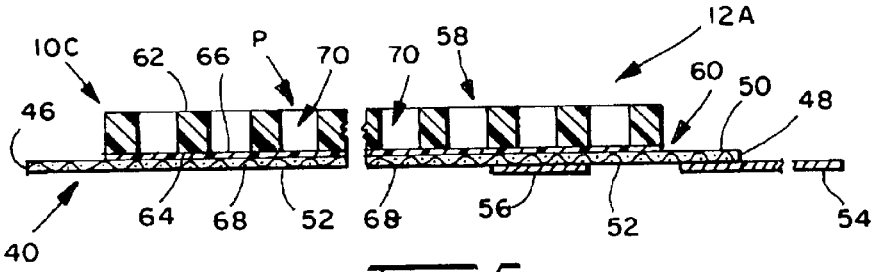
FIG. 6 is a sectional elevation view of a further embodiment of a pastel carrier in accordance with the invention; and, FIG. 7 is a sectional elevation view of still another embodiment of a pastel carrier in accordance with the invention.

FIG. 6 illustrates an embodiment of a pastel carrier designated 10C which is similar to the embodiment illustrated in FIG. 4 but in which strip 12 is replaced by strip 12A described above. Accordingly, like numerals appear in FIG. 6 for the component parts corresponding to strip 12A and fabric sheet 40 in FIGS. 4 and 5. As will be appreciated from the earlier embodiments, top side 62 of the strip 58 and bottom side 52 of sheet 40 respectively provide the inner and outer surfaces for the body of flexible material. Again, as will be appreciated from FIG. 3, the flexible body is adapted to be rolled from end 46 of sheet 40 toward end 48 thereof and, when rolled, to be releasably held in the rolled condition by cooperable Velcro fastener elements 54 and 56. In this embodiment, the ends and sides of sheet 40 can extend slightly beyond the ends and sides of sheet 60 and can be folded upwardly and inwardly of the end and side edges of sheet 60 to overlie top side 66 of sheet 60 about the periphery thereof, in the manner of a form fitting bed sheet, to optimize the securing of sheet 40 to sheet 60.

Figure 7:
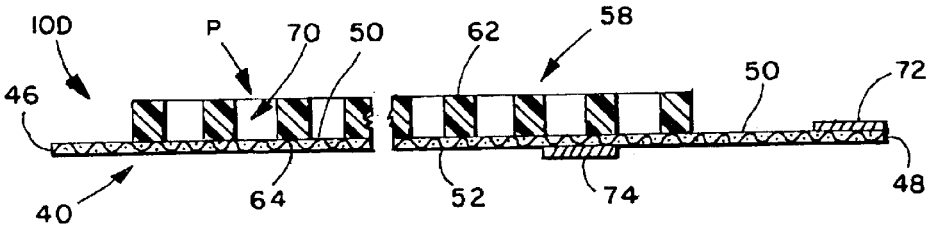

FIG. 7 illustrates yet another embodiment of a pastel carrier, designated 10D, in which the body of flexible material is defined by strip 58 and sheet 40, each as described hereinabove, and in which sheet 40 is suitably secured to bottom side 64 of strip 58 such as described in connection with the embodiments in FIGS. 4 and 5. Top side 50 of sheet 40 provides the bottom walls for pockets P, and bottom side 52 of the sheet provides the outer surface for the body of flexible material. In this embodiment, the pastel carrier is adapted to be releasably maintained in the rolled condition by cooperable Velcro fastener elements 72 and 74 which are respectively secured to the inner side 50 of sheet 40 at end 48 thereof and to the bottom side 52 of sheet 40 longitudinally inwardly of end 48. As will be appreciated from FIG. 3 the body of flexible material is adapted to be rolled from end 46 of sheet 40 toward end 48 thereof.

While considerable emphasis has been placed herein on the preferred embodiments and the structures and structural interrelationships between the component parts thereof, it will be appreciated that other embodiments can be made and that many changes can be made in the embodiments herein illustrated and described without departing from the principles of the present invention. In particular in this respect, it will be appreciated that the body of flexible material and the pockets therein can have dimensions other than those specifically referred to herein and, in connection therewith, that the carrier can have more or less than the four rows of pockets disclosed and/or more or less than the 50 pockets per row disclosed herein. Further, it will be appreciated that the body of flexible material can be defined, for example, by foam rubber, or by a strip of carpet-like material comprising a backing and pile extending upwardly therefrom and in which the pockets would be provided, for example, by removing the pile from the backing, such as by cutting, to provide a plurality of pockets as described herein for receiving chalk sticks. The foregoing and other modifications of the preferred embodiments and other embodiments of the invention will be suggested or obvious to those skilled in the art, whereby it is to be distinctly understood that the foregoing descriptive matter is to be merely as illustrative of the present invention and not as a limitation.

What is claimed is:

1. A carrier for clongate, cylindric chalk sticks comprising a body of flexible material having opposite ends, opposite sides and inner and outer surfaces, a plurality of chalk stick pockets extending into said body from said inner surface toward said outer surface, each said pocket having a bottom wall spaced from said inner surface, end walls extending vertically from said inner surface to said bottom wall and spaced apart in the direction between said sides and side walls extending vertically from said inner surface to said bottom wall and spaced apart in the direction between said ends, said side walls and said end walls providing for each said pocket to be elongated in the direction between said sides of said body, said body being rollable in the direction between said ends to form a roll enclosing said pockets within said outer surface of said body, said body of flexible material comprising a strip of resilient polymeric material having top and bottom sides, each said pocket extending through said strip from said top to said bottom side, a sheet of resilient polymeric material on said bottom side, and a sheet of fabric material on said sheet of polymeric material and providing said outer surface of said body, and each said pocket having a width and a depth equal to said width.

2. A carrier according to claim 1, wherein said plurality of pockets includes a plurality of rows of pockets spaced apart in the direction between said sides, and each said row comprising a plurality of pockets spaced apart in the direction between said ends.

3. A carrier according to claim 2, and means for releasably holding said roll against unrolling.

4. A carrier according to claim 2, and means on said sheet of fabric material for releasably holding said roll against unrolling.

5. A carrier according to claim 4, wherein said sheet of polymeric material has end edges and said sheet of fabric material extends beyond said end edges.

6. A carrier for elongate, cylindrical chalk sticks comprising a body of flexible material having opposite ends, opposite sides and inner and outer surfaces, a plurality of chalk stick pockets extending into said body from said inner surface toward said outer surface, each said pocket having a bottom wall spaced from said inner surface, end walls extending vertically from said inner surface to said bottom wall and spaced apart in the direction between said sides and side walls extending vertically from said inner surface to said bottom wall and spaced apart in the direction between said ends, said side walls and said end walls providing for each said pocket to be elongated in the direction between said sides of said body, said body being rollable in the direction between said ends to form a roll enclosing said pockets within said outer surface of said body, said body of flexible material comprising a strip of resilient polymeric material having top and bottom sides, each said pocket extending through said strip from said top to said bottom side, a sheet of resilient polymeric material covering said bottom side and providing said outer surface and a bottom for each said pocket, and each said pocket having a width and a depth equal to said width.

7. A carrier according to claim 6, wherein said plurality of pockets includes a plurality of rows of pockets spaced apart in the direction between said sides, and each said row comprising a plurality of pockets spaced apart in the direction between said ends.

8. A carrier according to claim 7, and means for releasably holding said roll against unrolling.

9. A carrier according to claim 7, and means on said sheet of polymeric material for releasably holding said roll against unrolling.

10. A carrier for elongate, cylindrical chalk sticks comprising a body of flexible material having opposite ends, opposite sides and inner and outer surfaces, a plurality of chalk stick pockets extending into said body from said inner surface toward said outer surface, each said pocket having a bottom wall spaced from said inner surface, end walls extending vertically from said inner surface to said bottom wall and spaced apart in the direction between said sides and side walls extending vertically from said inner surface to said bottom wall and spaced apart in the direction between said ends, said side walls and said end walls providing for each said pocket to be elongated in the direction between said sides of said body, said body being rollable in the direction between said ends to form a roll enclosing said pockets within said outer surface of said body, said body of flexible material comprising a strip of resilient polymeric material having top and bottom sides, each said pocket extending through said strip from said top to said bottom side, and a sheet of fabric material covering said bottom side and providing said outer surface and a bottom for each said pocket, and each said pocket having a width and a depth equal to said width.

11. A carrier according to claim 10, wherein said plurality of pockets includes a plurality of rows of pockets spaced apart in the direction between said sides, and each said row comprising a plurality of pockets spaced apart in the direction between said ends.

12. A carrier according to claim 11, and means for releasably holding said roll against unrolling.

13. A carrier according to claim 11, and means on said sheet of fabric material for releasably holding said roll against unrolling.

14. A carrier according to claim 13, wherein said sheet of polymeric material has end edges and said sheet of fabric material extends beyond said end edges.

* * * * *